US010208495B2

(12) United States Patent
Francis

(10) Patent No.: US 10,208,495 B2
(45) Date of Patent: Feb. 19, 2019

(54) TWO PITCH BLEACHER

(71) Applicant: biljax, inc., Archbold, OH (US)

(72) Inventor: Einstein Francis, Archbold, OH (US)

(73) Assignee: Biljax, Inc., Archbold, OH (US)

( * ) Notice: Subject to any disclaimer, the term of this patent is extended or adjusted under 35 U.S.C. 154(b) by 0 days.

(21) Appl. No.: 15/792,905

(22) Filed: Oct. 25, 2017

(65) Prior Publication Data

US 2018/0135321 A1 May 17, 2018

Related U.S. Application Data

(60) Provisional application No. 62/422,720, filed on Nov. 16, 2016.

(51) Int. Cl.
*E04H 3/12* (2006.01)
*E04B 1/24* (2006.01)

(52) U.S. Cl.
CPC ..... *E04H 3/126* (2013.01); *E04B 2001/2457* (2013.01)

(58) Field of Classification Search
CPC ... E04H 3/12; E04H 3/126; E04B 2001/2457; E04B 2001/2415
See application file for complete search history.

(56) References Cited

U.S. PATENT DOCUMENTS 1,744,137 A * 1/1930 Oberdorfer ..... E04H 3/12 182/106
2,663,914 A 12/1953 Mackintosh
2,854,704 A * 10/1958 Gilbert ..... E04H 3/12 52/190
2,888,182 A 5/1959 Nixon
3,279,131 A 10/1966 Curra, Jr.
3,928,951 A * 12/1975 Murphy ..... E04B 1/2403 52/715
4,195,451 A * 4/1980 Jarvis ..... A47C 1/126 52/8
4,611,439 A * 9/1986 Graham, Jr. ..... E04H 3/126 52/143
4,862,650 A * 9/1989 Brasil ..... A47C 1/12 52/9
4,872,297 A * 10/1989 Hetzel ..... E04B 7/04 52/91.1
5,660,000 A * 8/1997 MacIntyre ..... E04H 3/126 108/115
6,003,270 A * 12/1999 MacIntyre ..... E04H 3/126 52/10
6,474,024 B1 11/2002 Macintyre
6,820,374 B2 * 11/2004 Schworer ..... E04H 3/126 52/7
8,296,999 B2 10/2012 Uhl
8,407,943 B2 4/2013 Sudkamp
(Continued)

FOREIGN PATENT DOCUMENTS

GB 2229205 A * 9/1990 ..... E04H 3/12

*Primary Examiner* — Beth A Stephan
(74) *Attorney, Agent, or Firm* — Schaffer, Schaub & Marriott LTD

(57) ABSTRACT

This two pitch beam is for a bleacher support system in which the slope of its understructure is a combination of a shallow pitch section and a steep pitch section. The unique longitudinal support beam is used for both the shallow pitch and steep pitch sections.

15 Claims, 16 Drawing Sheets

(56) References Cited

U.S. PATENT DOCUMENTS

| | | | | |
|---|---|---|---|---|
| 2009/0193722 | A1* | 8/2009 | Carlson | A63C 19/10<br>52/6 |
| 2011/0113725 | A1* | 5/2011 | Garry | B21D 47/01<br>52/838 |
| 2012/0117781 | A1* | 5/2012 | Jones | A47C 1/16<br>29/428 |

* cited by examiner

TWO PITCH BLEACHER

CROSS-REFERENCE

The present patent application is based upon and claims the benefit of provisional patent No. 62/422,720, filed Nov. 16, 2016. The disclosure of Ser. No. 62/422,720, filed Nov. 16, 2016 is hereby incorporated by reference.

TECHNICAL FIELD

This invention relates to a bleacher and its support system in which the slope of its understructure is a combination of a shallow pitch section and a steep pitch section. A unique longitudinal support beam is used for both the shallow pitch and steep pitch sections.

BACKGROUND OF THE INVENTION

Sporting and exhibition venues or facilities often include temporary or portable bleacher-style seating systems to provide spectators with unobstructed views of a sporting event or other activity taking place at the venue. Certain types of events call for different types of bleacher seating such as, for example, a relatively steep slope for the spectators of a hockey game or any outdoor events, and a relatively shallow slope for the spectators of a basketball game or any indoor events.

Variable riser seating system in which the slope of its understructure is variable to provide variable sight lines for multiple stadium/arena configurations have been developed. However, the known prior art systems generally are a complex structure that requires many moving parts. The complexity brings into question the reliability and economy of such systems.

SUMMARY OF THE INVENTION

The present invention provides a bleacher seating system comprising a unique longitudinal support beam (universal beam). The unique longitudinal support beam (universal beam) is used for both the shallow pitch and steep pitch sections. The bleacher support system also include a transitional beam. The universal beam has a first surface with a shallow pitch support frame bracket attached to the first surface. The beam also has a second surface, opposite the first surface, with a steep pitch support frame bracket attached to the second surface. The bleacher setup starts with a starter beam every time. The starter beams are unique for shallow pitch and steeper pitch. The longitudinal beam (universal beam) is connected to the starter beam on both pitch cases. The universal beams are supported by a saddle and the saddles are sitting on top of the scaffolding. When you want to change the pitch from shallow to steeper pitch use the transition beam. The transition beam will connect to the end of the universal beam and the other end will be connected starter side of the universal beam. The steeper pitch setup you have to turn the beam upside down. The beams are connected by an insert. The two adjacent universal beams are connected by a universal support frame. The universal support frame will provide the supporting structure for the walking platform and the space for the seat frame.

The two pitch beam is for a bleacher support system in which the slope of its understructure is a combination of a shallow pitch section and a steep pitch section. The unique longitudinal support beam (Universal beam) is used for both the shallow pitch and steep pitch sections.

The universal beam has a first surface with a shallow pitch support frame bracket attached to the first surface. The beam also has a second surface, opposite the first surface, with a steep pitch support frame bracket attached to the second surface. When the first surface is the top of the beam, the beam provides a shallow pitch. When the second surface is the top of the beam, the beam provides a steep pitch.

This dual pitch (2P) bleacher provides less under structure and more efficient use of scaffold. When changing from one slope to other slope all the parts are self adjustable. There is no need to manually adjust any of the components.

In a preferred embodiment, the shallow pitch support beam forwardly extends from the transition beam and the steep pitch support beam rearwardly extends from the transition beam.

Other objects and advantages of the present invention will become apparent to those skilled in the art upon a review of the following detailed description of the preferred embodiments and the accompanying drawings.

BRIEF DESCRIPTION OF THE DRAWINGS

The drawings show the components of the pitch specific, bleacher seating system of this invention. The components include a starter beam, a universal beam and a transition beam. The universal beam is used with both shallow pitch and the steep pitch. Also shown are a shallow pitch frame bracket and a steep pitch frame bracket. See FIG. 2, items 14 and 18. Other components such as a saddle and inserts are shown.

DETAILED DESCRIPTION OF THE INVENTION

The following details various arrangements and configurations of the pitch specific, bleacher seating system of this invention.

Figure 1:
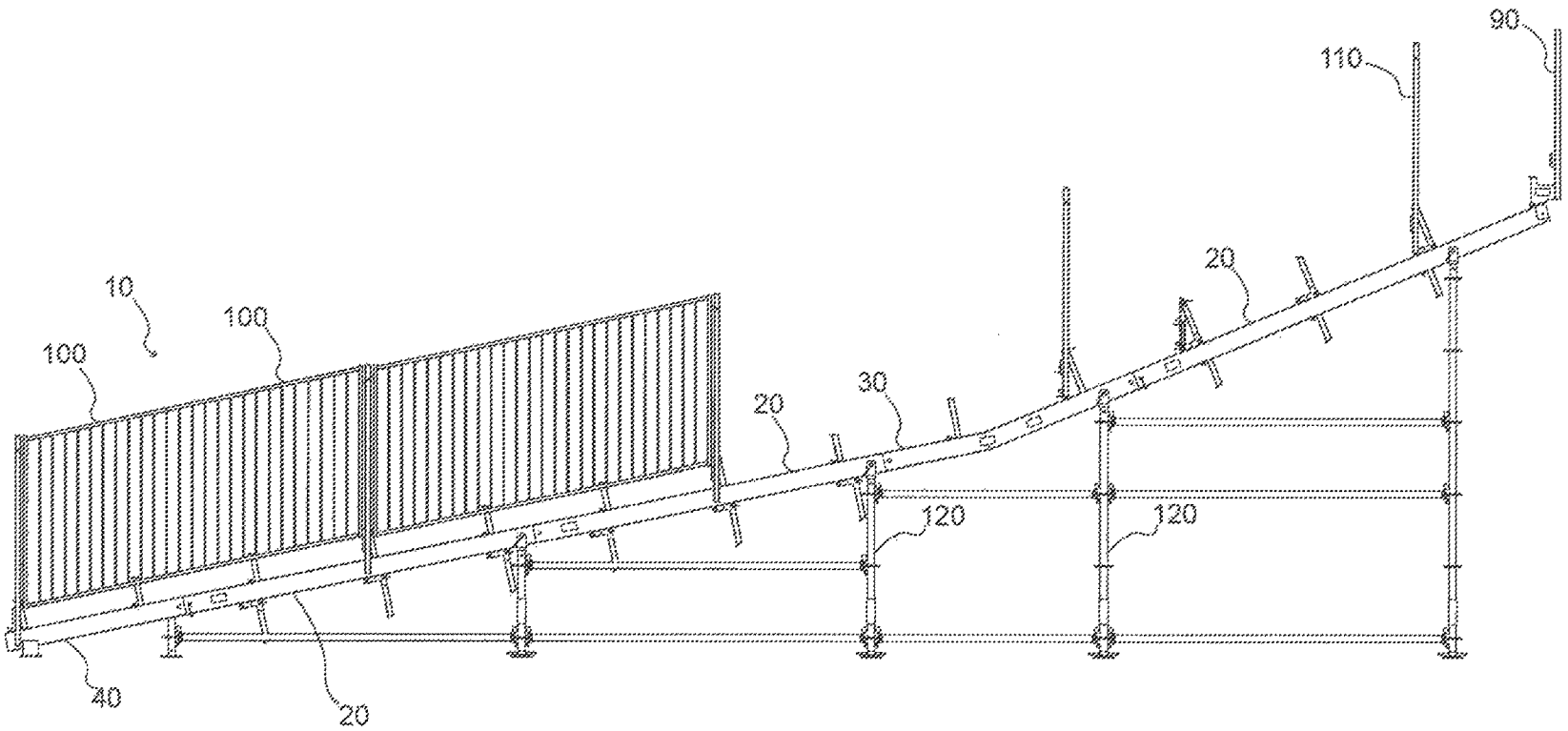
FIG. 1 is a side elevational view of the two pitch bleacher system according to the invention.

FIG. 1 is a side elevational view of the two pitch bleacher system according to the invention. FIG. 1 shows two pitch bleacher seating system 10. System 10 includes longitudinal support beams 20, transitional beam 30 and starter beam 40. Also shown are side guard rails 100.

Figure 2:
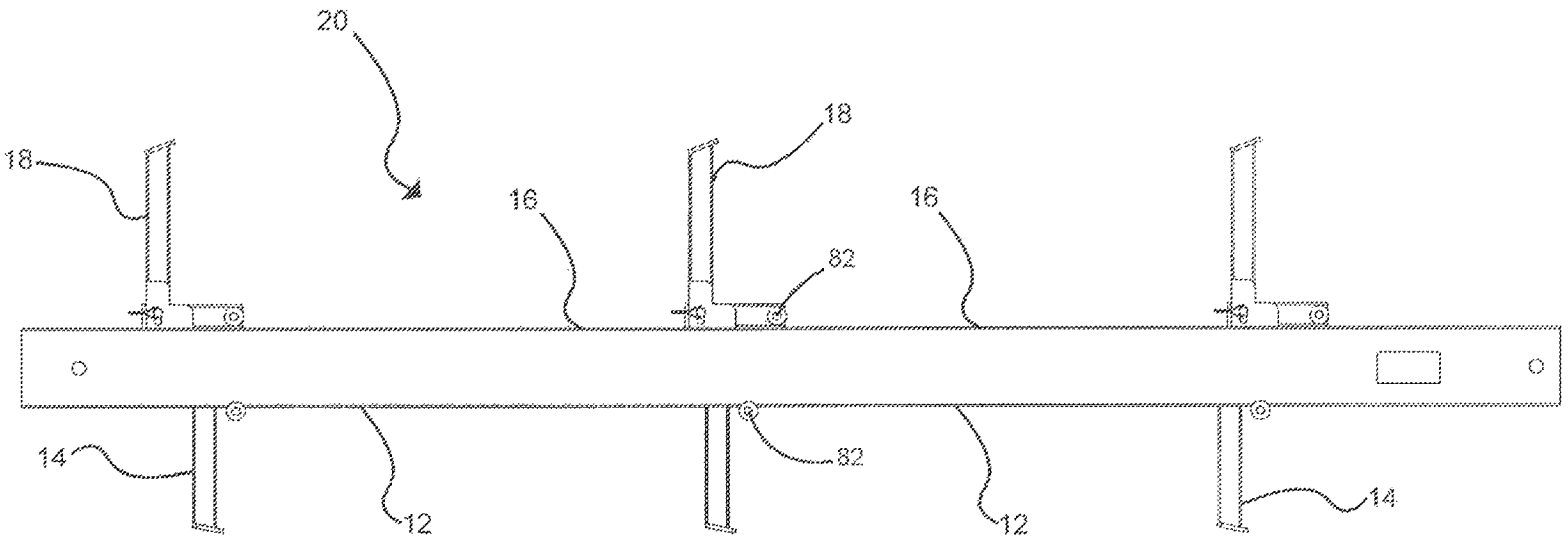
FIG. 2 is a view of a longitudinal support beam (universal beam) for use in a two pitch bleacher.

FIG. 2 is a view of longitudinal support beam 20 for use in a two pitch bleacher 10, Beams 20 has a first surface 12 with a shallow pitch bracket 14 attached to the first surfaces 12, Beams 20 have a second surface 16 opposite first surface 12 with a steep pitch bracket 18 attached to second surface 16. When beams 20 have a shallow pitch beam, first surface 12 is a top surface. When beam 20 is a steep pitch beam, second surface 16 is a top surface. Also shown is pin 82 adjacent bracket 14 and adjacent bracket 18.

Figure 3:
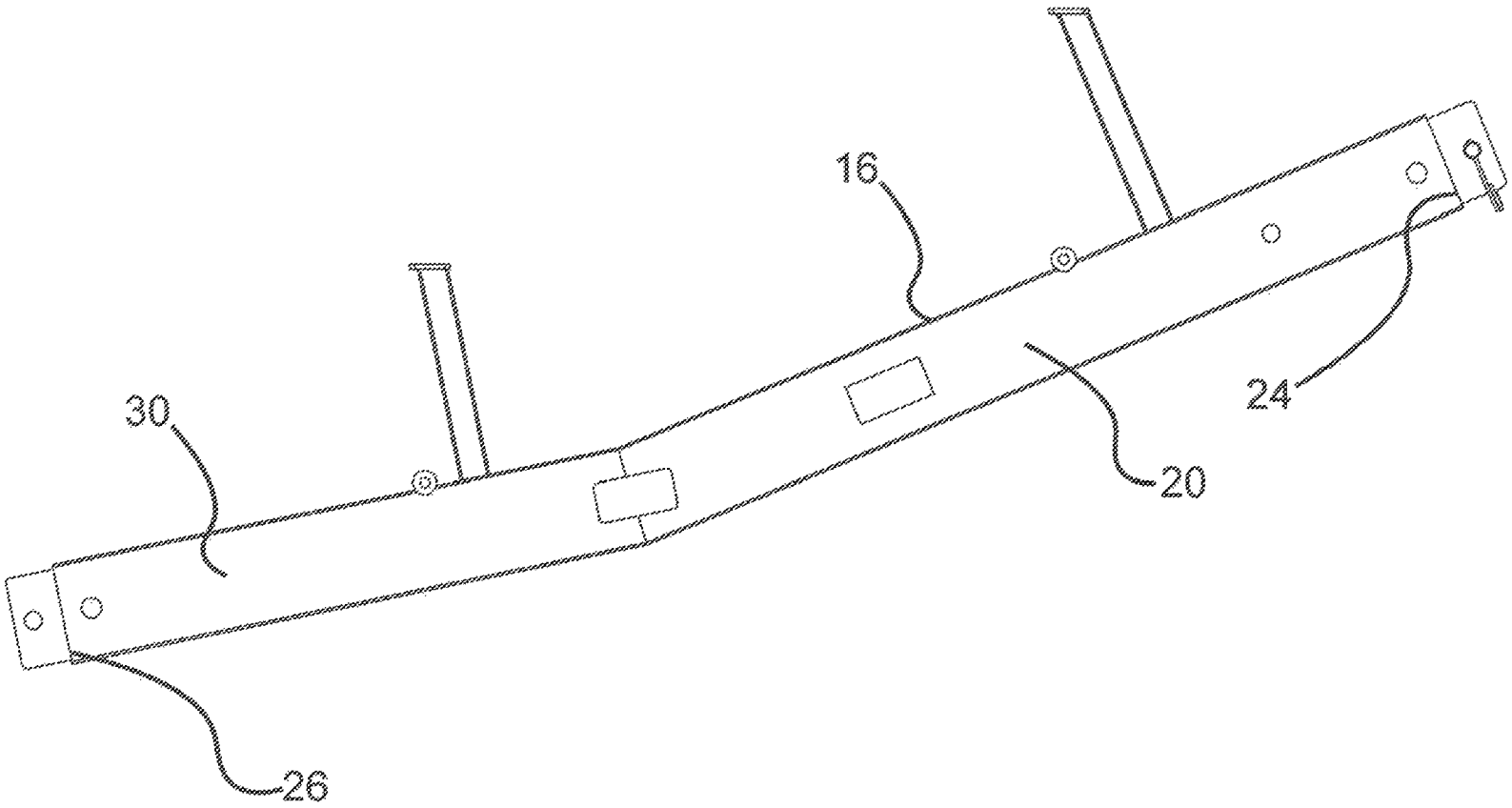
FIG. 3 is a view of a two pitch bleacher including a transitional beam.

FIG. 3 is a view of a two pitch bleacher including transitional beam 30. Bleacher support system 10 comprises transitional beam 30 having a first end 24 and a second end 26. Beam 20 attached to first end 24 is a steep pitch beam with second surface 16 a top surface.

Figure 4A:
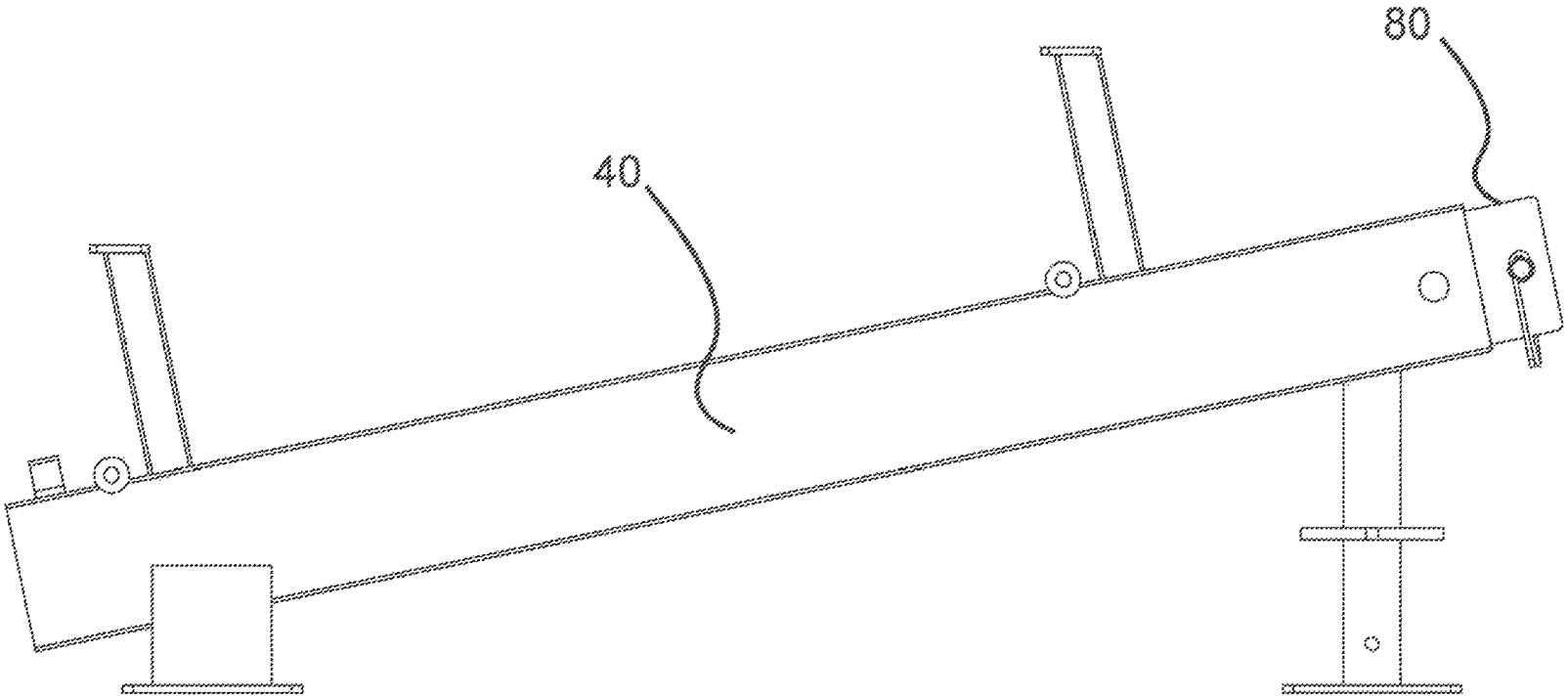
FIG. 4A is a view of a starter beam for 0.5 M pitch.

FIG. 4A is a view of starter beam 40 attached to a longitudinal support beam 20. Preferably starter beam 40 is attached to a forwardly end of shallow pitch support beam 20.

Figure 4B:
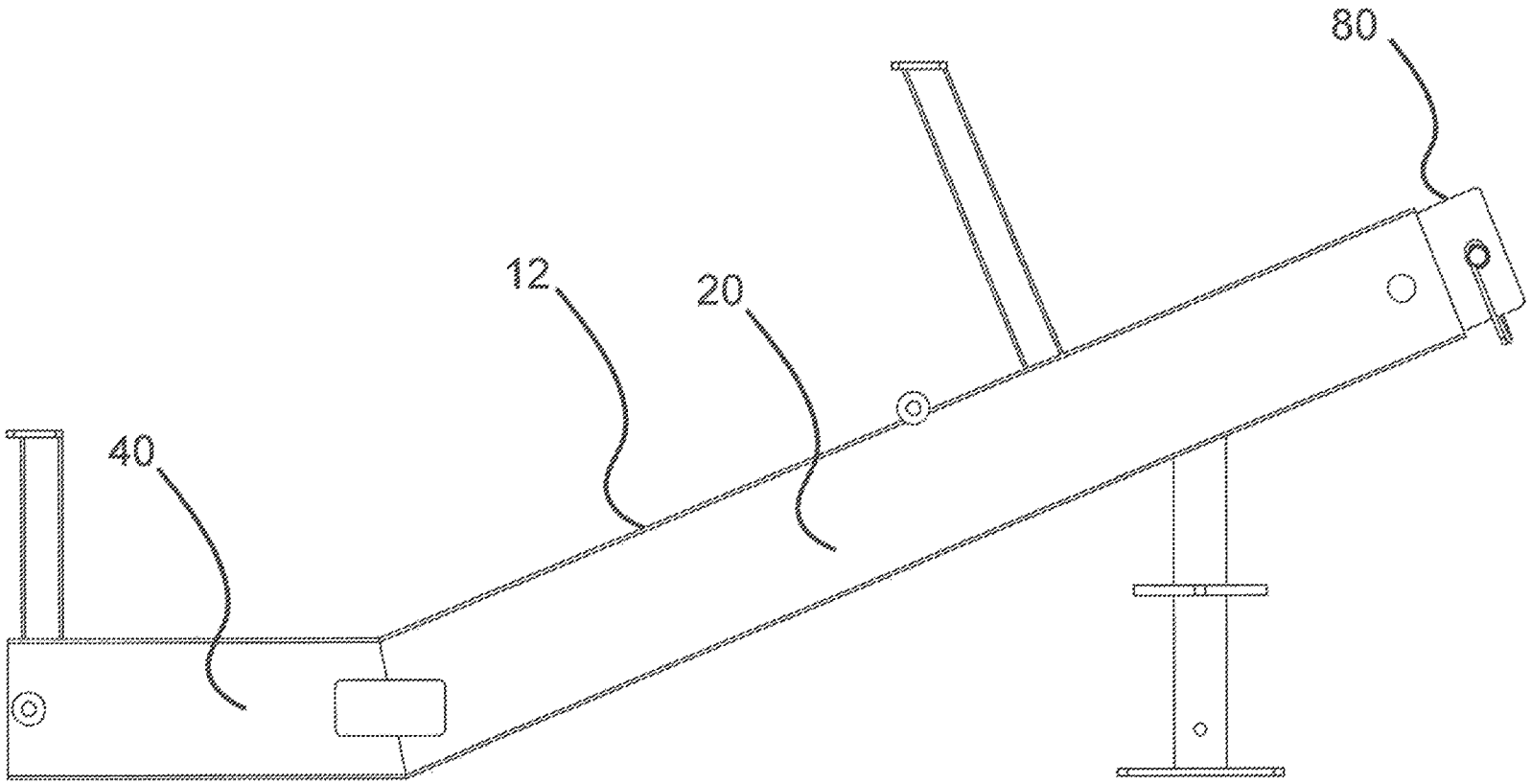
FIG. 4B is a view of a starter beam for 1.0 M pitch attached to a longitudinal support beam.

FIG. 4B is a view of starter beam 40 attached to a longitudinal support beam 20. Preferably starter beam 40 is attached to a forwardly end of shallow pitch support beam 20.

Figure 5:
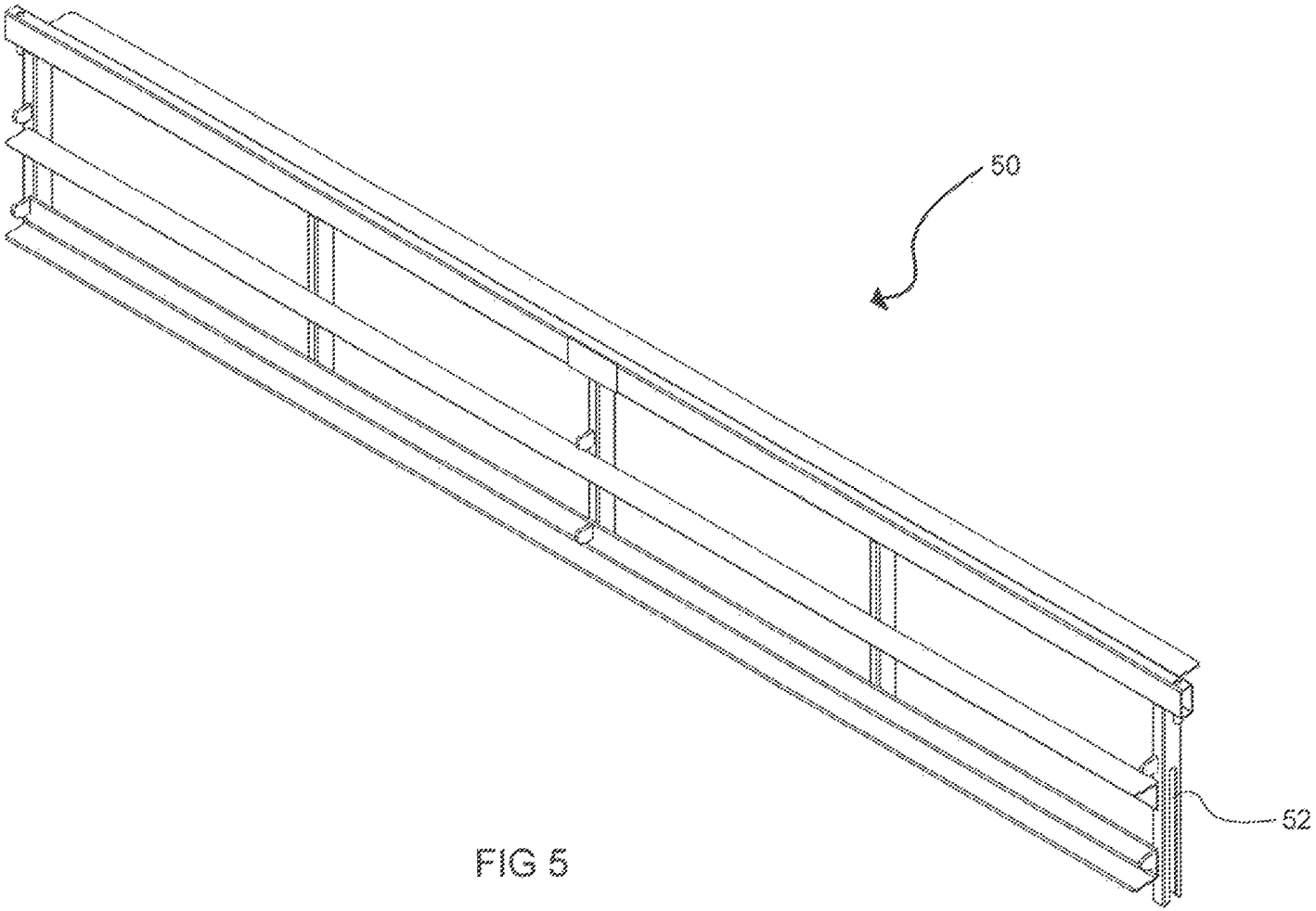
FIG. 5 is a universal supper frame which spans at least two adjacent longitudinal support beam.

FIG. 5 is a universal support frame 50 that spans at least two adjacent longitudinal support beams 20. Support frame 50 will support universal seat frames. See FIG. 6.

Figure 6:
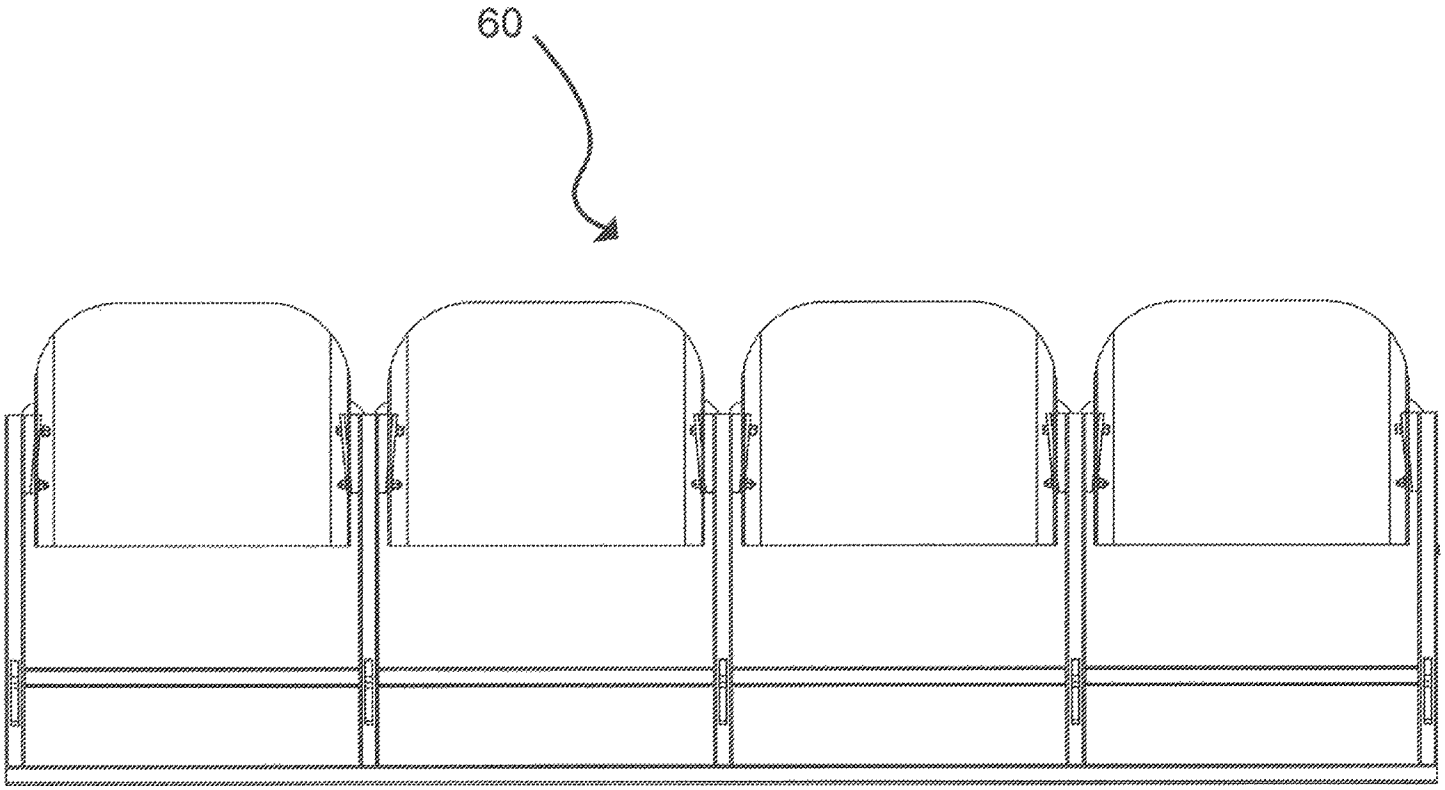
FIG. 6 shows universal seat frames which are supported by the universal support frames of FIG. 5.

FIG. 6. shows universal seat frames which are supported by the universal support frames 50 of FIG. 5. Universal seat frame 60 may embody a 5 seat frame, a 4 seat frame, a 3 seat frame, a 2 seat frame, and a 1 seat frame. The components of seat frame 60 also may be a combination thereof. Shown is a 4 seat frame.

Figure 7:
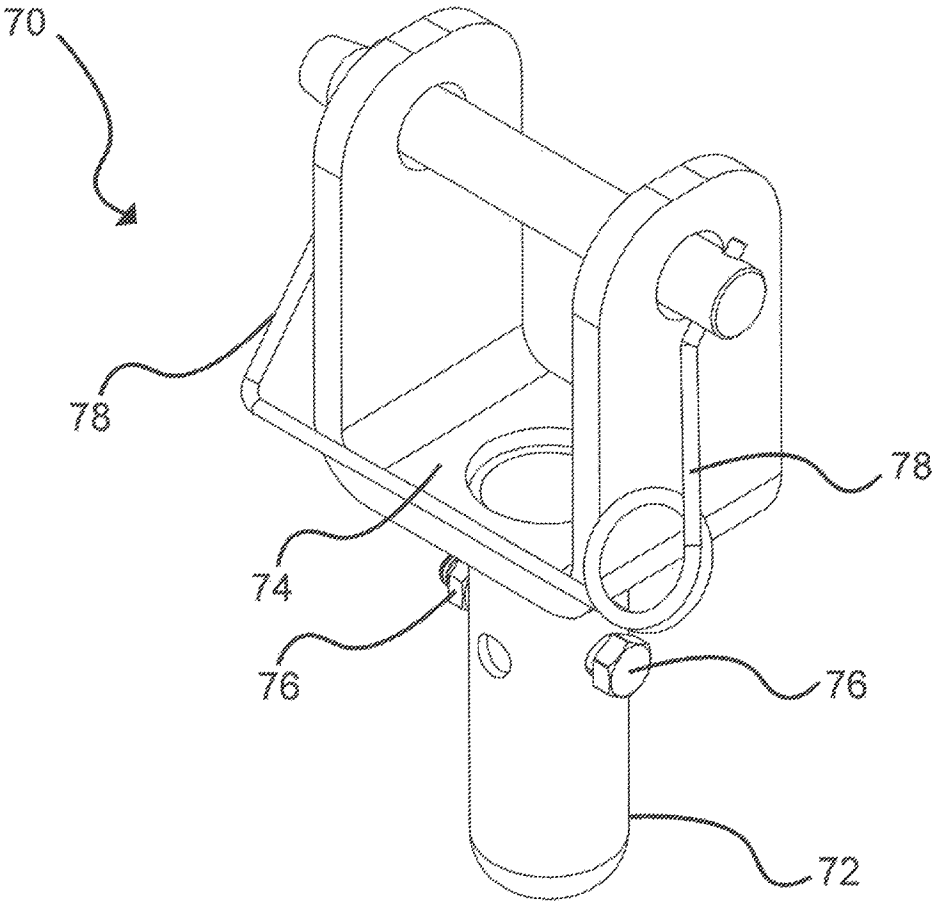
FIG. 7 shows saddle components for assembly of the system of FIG. 1.

FIG. 7 shows saddle components for assembly of the system of FIG. 1. Saddle 70 includes insert 72, platform 74, hex jam nut 76, and pin snap lock shores 78. Insert 72 is supported by scaffolding 120. See FIG. 1. Saddle 70 supports longitudinal support beams 20 or inserts 80. See FIG. 1 and FIG. 8. Platform 74 supports beams 20 or insert 80.

Figure 8:
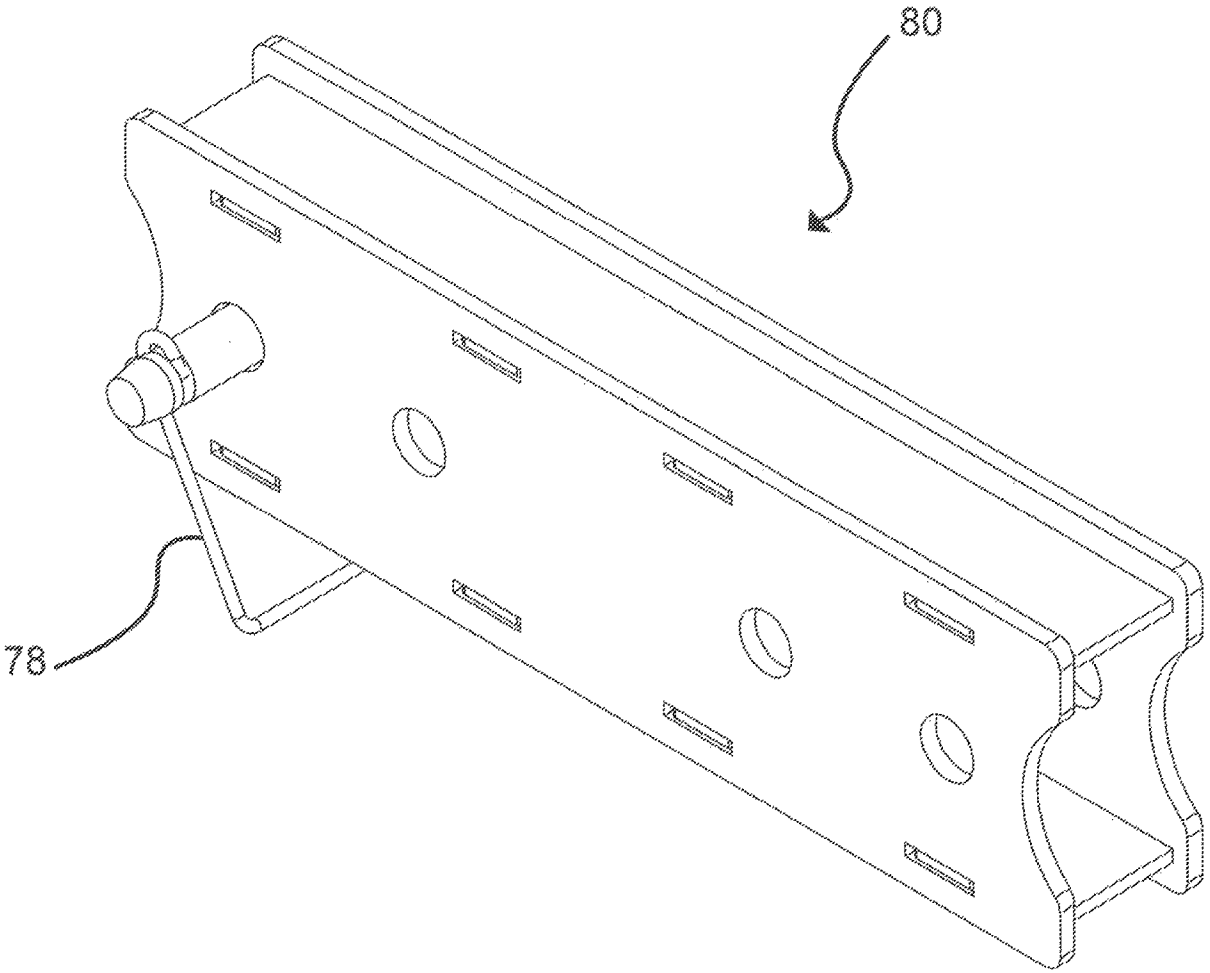
FIG. 8 shows an insert to connect two longitudinal support beams.

FIG. 8 shows an insert to connect two longitudinal support beams. For example, insert 80 connects to beams 20. Also shown is pin snap lock shore 78.

Figure 9:
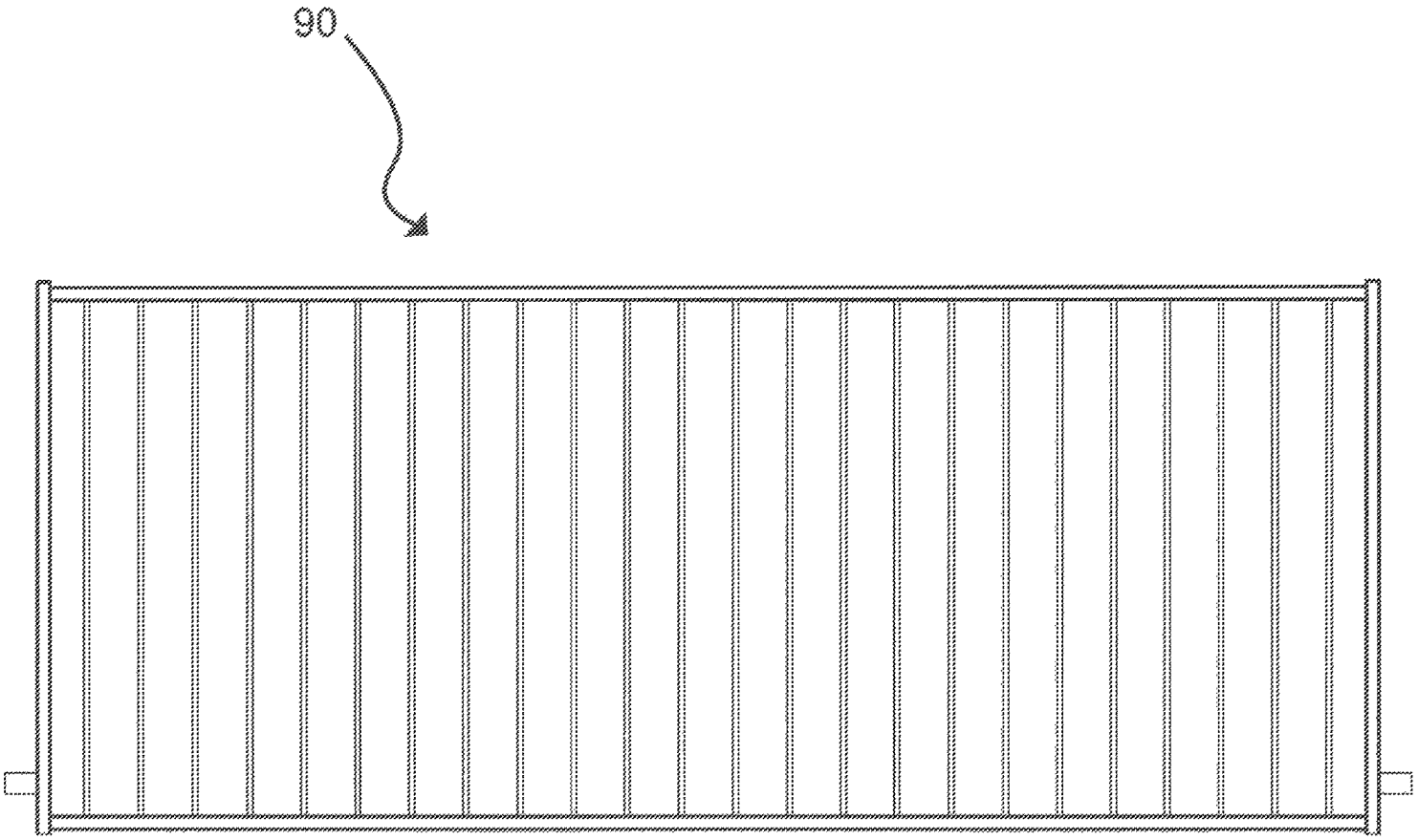
FIG. 9 shows a rear guard rail for use in the system of FIG. 1.

FIG. 9 shows a rear guard rail for use with the systems of FIG. 1. Rear guard rail 90 is shown.

Figure 10:
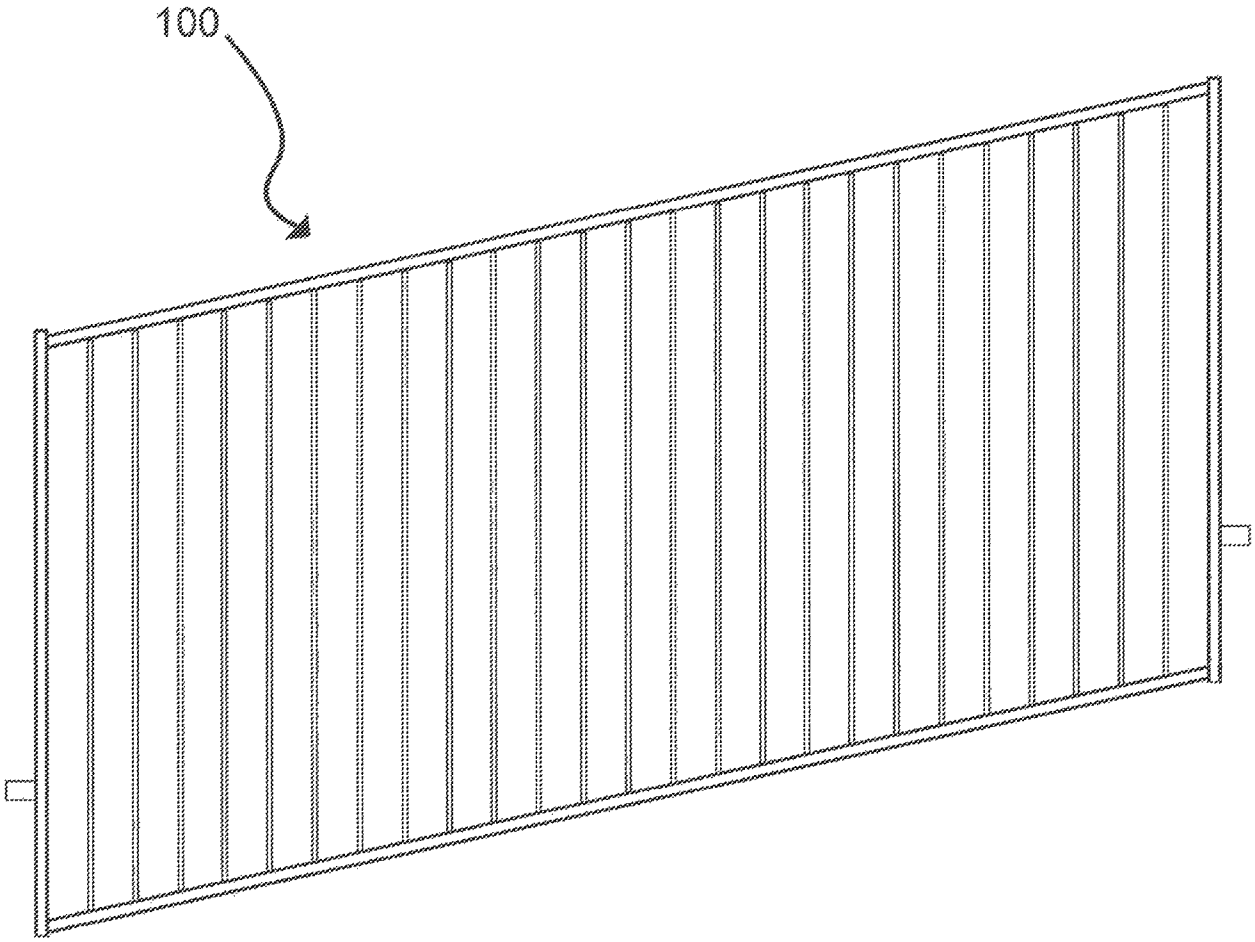
FIG. 10 shows a side guard rail for use in the system of FIG. 1.

FIG. 10 shows a side guard rail for use with the system of FIG. 1. Side guard rail 100 is shown.

Figure 11:
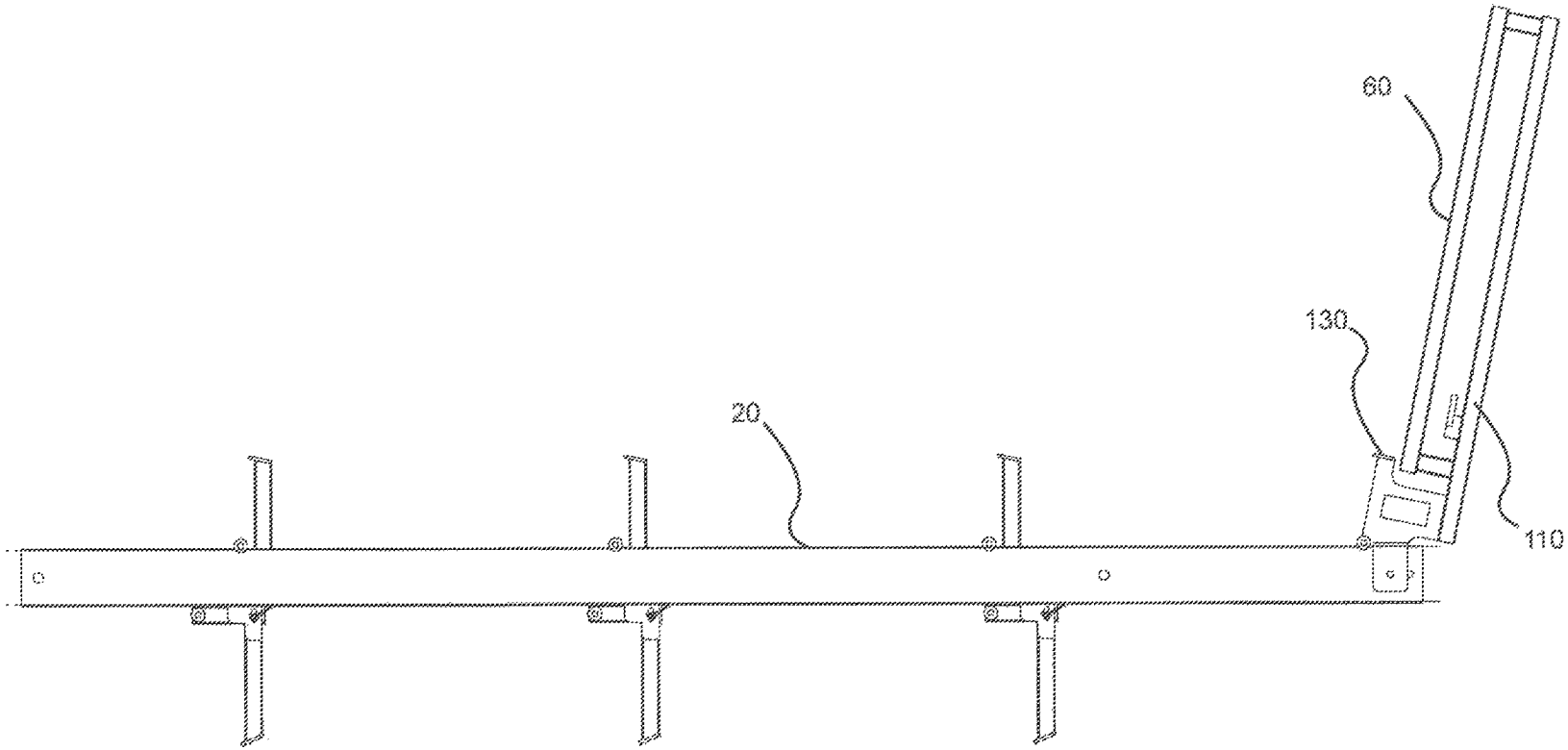
FIG. 11 shows a rear beam to accommodate a seat frame and a guard rail post.

FIG. 11 shows a rear beam to accommodate a seat frame and a guard rail post Rear beam 110 is shown attached to beam 20 with seat support plate 130. Rear guard rail post 110 is shown with seat frame 60 in the up position.

Figure 12A:
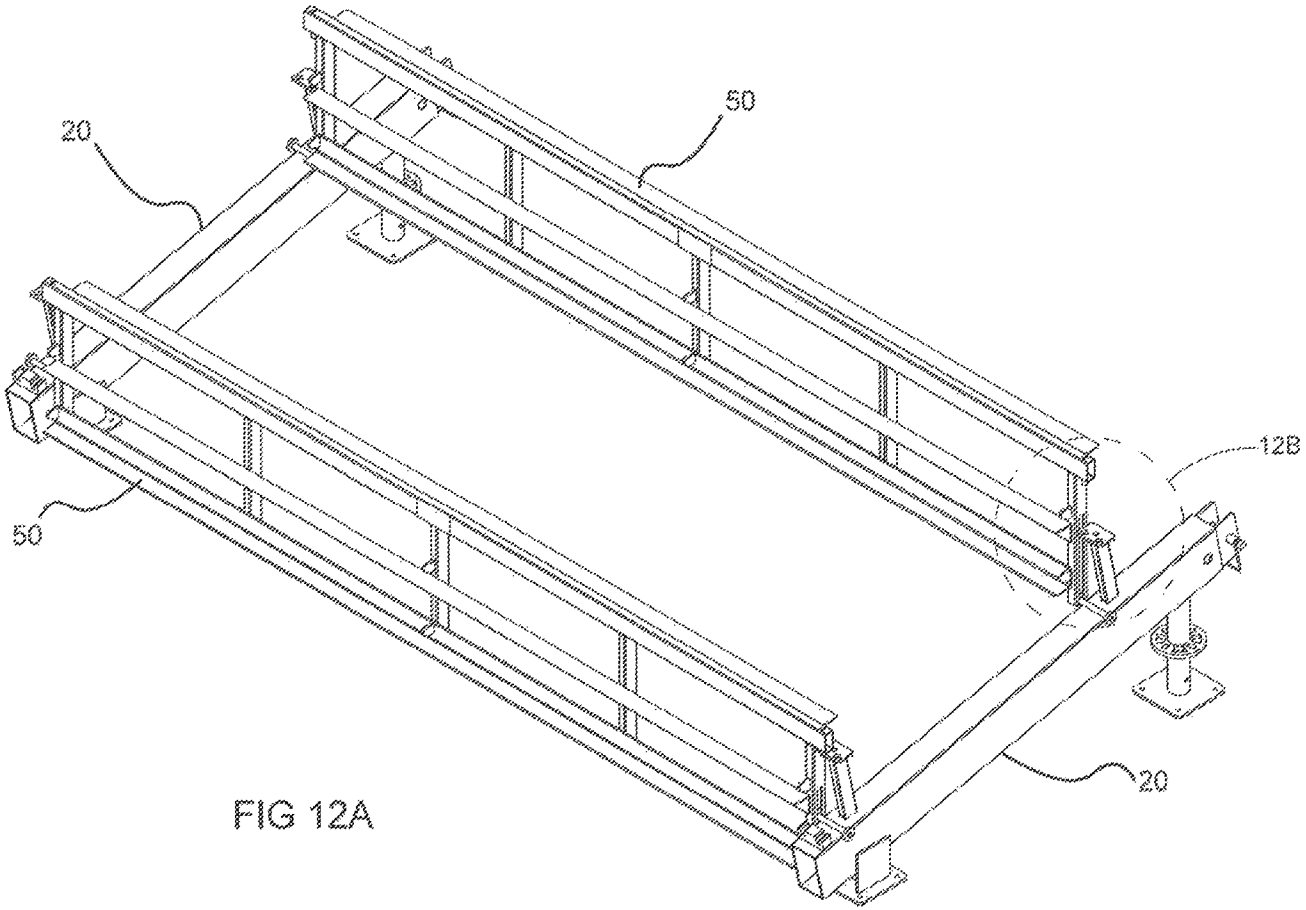
FIG. 12A show the connection for universal support frames to universal beams.

FIG. 12A shows the connection for universal support frames to universal beams. Shown are beams 20 supporting universal support frames 50. Support frames 50 will provide the supporting structure for the walking, platform and seat frames 60. Support frames 50 have vertical slots 52 in members 54. Slot 52 are the key to using beam 20 for a shallow pitch or steep pitch. See FIG. 12B.

Figure 12B:
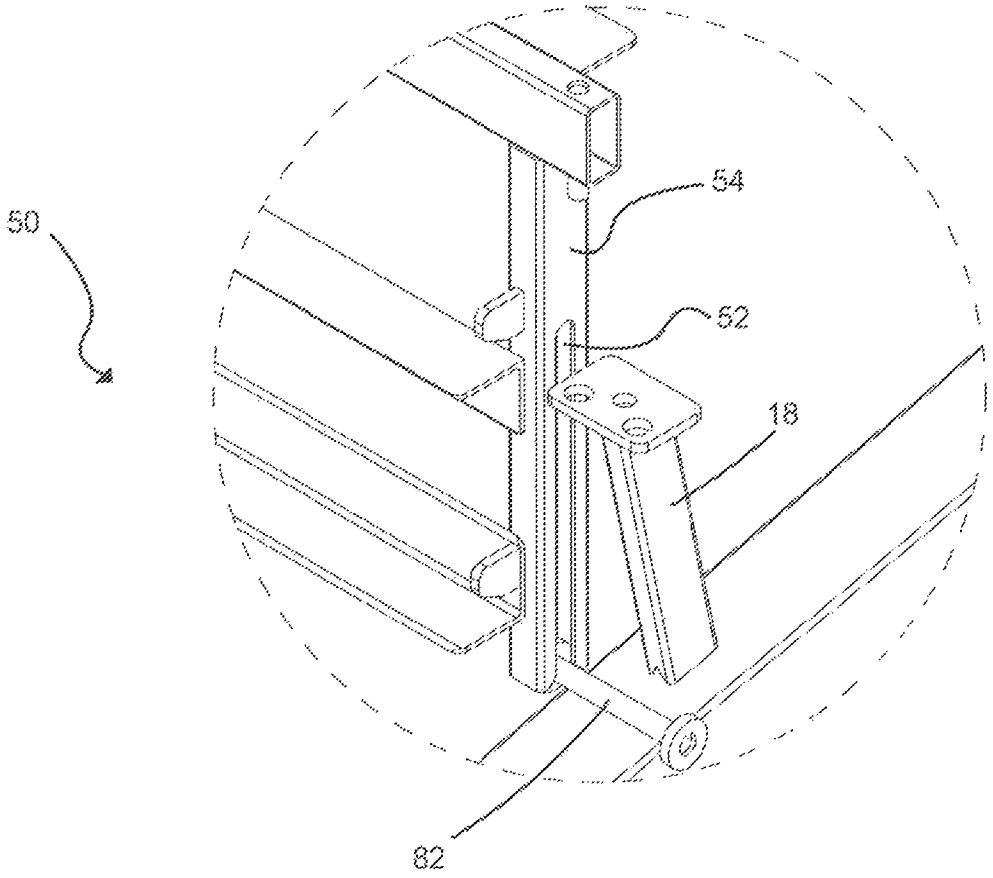
FIG. 12B is an enlarged view showing the connection of FIG. 12A in greater detail.

FIG. 12B is an enlarged view showing the connection of FIG. 12A in greater detail. Vertical slot 52 allows for the attachment of shallow pitch bracket 14 or steep pitch bracket 18 depending upon how beam 20 is positioned. See FIG. 2. Also shown is pin 82 engaging slot 52.

Figure 13A:
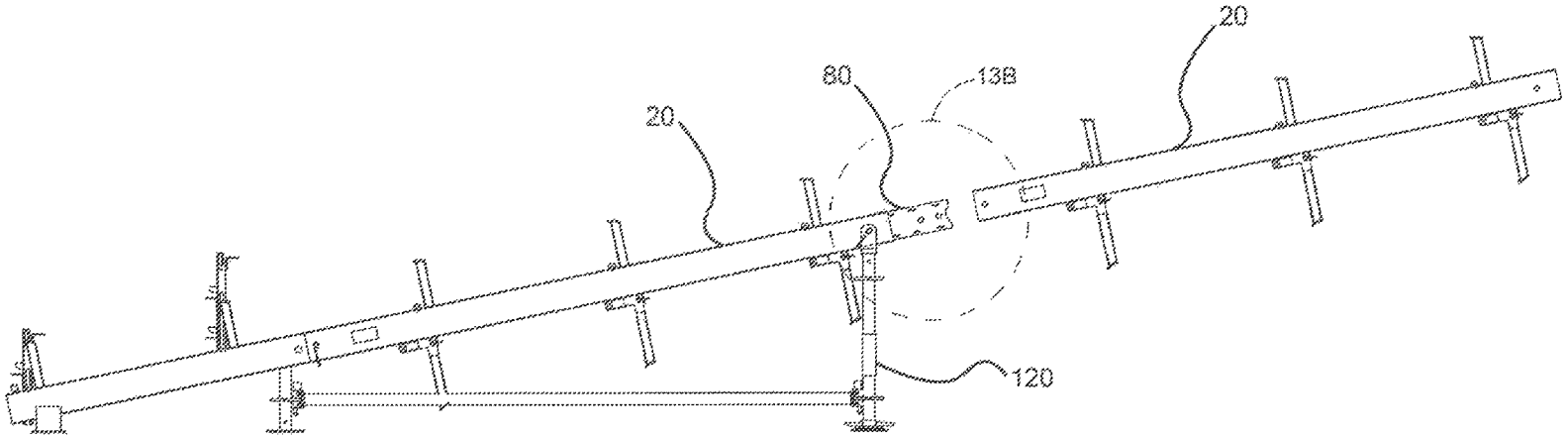
FIG. 13A shows two adjacent invert beams connected by an insert.

FIG. 13A shows two adjacent universal beams connected by an insert. Shown are beams 20 and insert 80 in position.

Figure 13B:
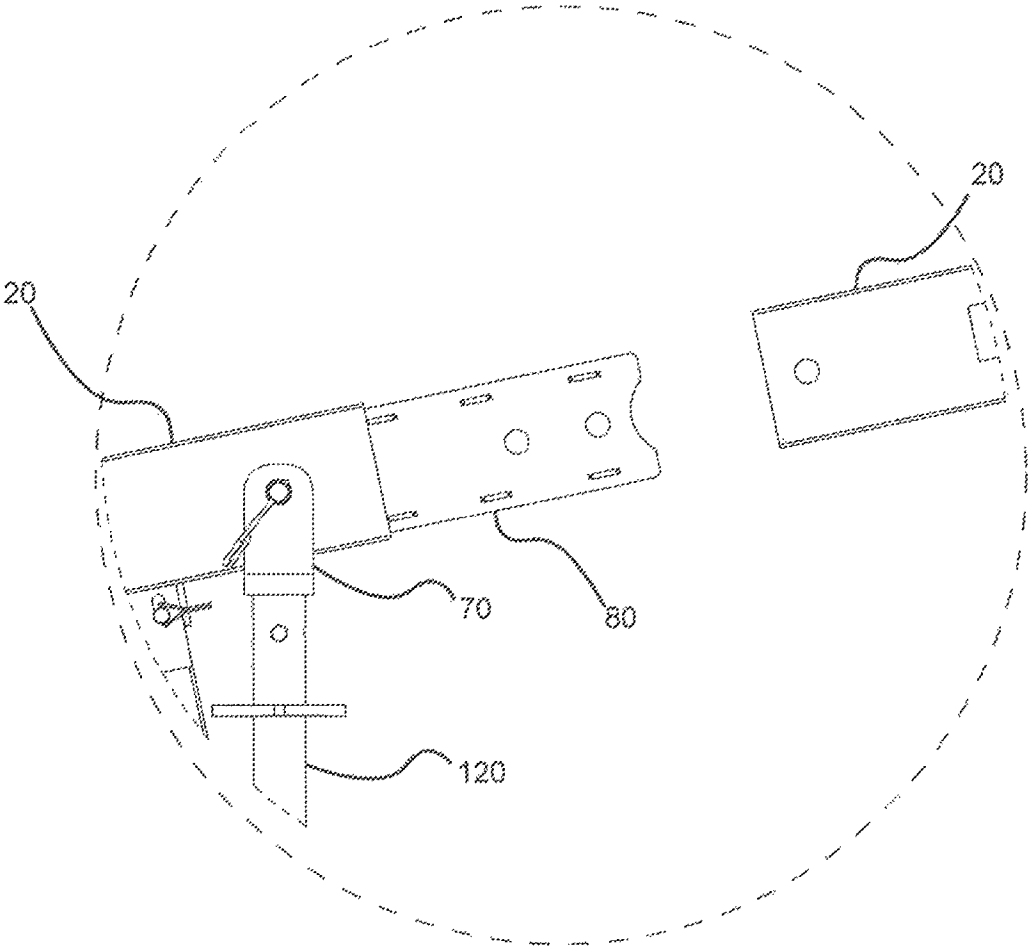
FIG. 13B is an enlarged view of the connection of FIG. 13A shown in greater detail.

FIG. 13B is an enlarged view of the connection of FIG. 13A shown in greater detail.

This Dual Pitch (2P) bleacher can start with a shallow pitch and gradually convert to a steeper pitch. The bleacher allows for less under structure and more efficient use of scaffold. The scaffold grid is 8 ft×8 ft or 2.5 M×2.5 M–one bay covers 64 sq ft of flooring VS AB Elite with grid of 5 ft×10 ft so only 50 sq ft is covered per bay. This new design covers 22% more area than the AB Elite which translates to less understructure per seat. The added area allows an increase of 15 seats per bay VS AB Elite's, 12 seats per bay. More leg room per seat. The run of each bleacher step is 32" VS the AB Elite at only 30". The seat and the aisle are floating (not fixed to the beam). This gives you flexibility to change the aisle size and location of the seats. When you change from one slope to other slope all the parts are self-adjustable. No need to manually adjust any of the components.

Possibilities for future product development include front walkway with ADA compliant access, reverse the current offering and start with a steeper pitch and transition to a shallow pitch, develop a new Tip-Up Seat design, and develop a frame to accommodate bench seating and different brand seats.

The understructure can consist of a ring system, a cup lock system, and any system scaffolding with METRIC verticals. The scaffold, understructure grid is 8 ft×8 ft or 2,5 M×2,5 M.

The 2P shallow pitch has a 32" deep step (run)×6½" rise (11.6° slope). The 2P steeper pitch is a 32" deep step (run)×13⅛' rise (22.3° slope). AB Elite pitch has a 30" deep step (run)×9.84" rise (18" slope).

Transition beams, and 5'4"horizontals are utilized for a smooth transition eliminating intermediate walkways.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not limitative sense, the scope of the invention being defined by the appended claims.

I claim:

1. A longitudinal support beam for use in a bleacher support system;

wherein the beam has a first surface with a shallow pitch bracket attached to the first surface; and wherein the beam has a second surface, opposite the first surface, with a steep pitch bracket attached to the second surface;

wherein the beam is a shallow pitch beam when the first surface is a top surface;

wherein the beam is a steep pitch beam when the second surface is a top surface;

wherein a pin is attached to the second surface adjacent said steep pitch support bracket; and wherein the pin is perpendicular to the steep bracket and extends outwardly on each side of the second surface.

2. A longitudinal support beam according to claim 1 wherein the shallow pitch bracket is welded to the first surface.

3. A longitudinal support beam according to claim 1 wherein the steep pitch bracket is mechanically attached to the second surface.

4. A bleacher support system comprising the combination of:

a shallow pitch longitudinal support beam according to claim 1;

a transitional beam;

wherein the shallow pitch support beam is attached to a first end of the transition beam;

a steep pitch longitudinal support beam according to claim 1;

wherein the steep pitch support beam is attached to a second end of the transition beam; and wherein a pin is attached to the second surface adjacent said steep pitch support bracket; and wherein the pin is perpendicular to the steep pitch bracket and extends outwardly on each side of the second surface; and a longitudinal support frame wherein the support frame has a plurality of slots therein.

5. A bleacher support system according to claim 4 further comprising a starter beam attached to a forwardly end of the shallow pitch support beam.

6. A bleacher support system comprising the combination of:

a pair of parallel longitudinal support beams according to claim 1; and a plurality of longitudinal support frames having a plurality of slots therein;

wherein the support frames are perpendicular to the parallel support beams;

wherein he support frames are located between the parallel support beams;

wherein the support frames are attached to the parallel support beams; and at least one saddle wherein each of the saddles supports a longitudinal support beam.

7. A bleacher support system according to claim 6:

wherein a pin is attached to the second surface adjacent each steep pitch bracket of each longitudinal support beam; and wherein each support frame has a plurality of slots therein.

8. A bleacher support system according to claim 7 wherein each pin of the longitudinal support beam engages a slot of the support frame.

9. A bleacher support system according to claim 6 further comprising scaffolding to support the system.

10. A bleacher support system according to claim 9 wherein the scaffolding includes scaffolding legs wherein the legs support a saddle.

11. A bleacher support system according to claim 10 wherein the saddle includes a saddle insert wherein the saddle insert engages the scaffolding leg.

12. A bleacher support system comprising at least one pair of spaced longitudinal support beams wherein each of the longitudinal support beams comprises a combination of a first support beam having a shallow pitch, a second support beam haying a steep pitch;

a transition beam having a first end and a second end; and wherein the shallow pitch support beam is attached to the first end of the transition beam and the steep pitch support beam is attached to the second end of the transition beam;

wherein a pin is attached to the second surface adjacent said steep pitch support bracket; and wherein the pin is perpendicular to the steep pitch bracket and extends outwardly on each side of the second surface.

13. A bleacher support system according to claim 12 wherein the shallow pitch support beam forwardly extends from the transition beam and the steep pitch support beam rearwardly extends from the transition beam.

14. A bleacher support system according to claim 12 wherein the steep pitch support beam forwardly extends from the transition beam and the shallow pitch support beam rearwardly extends from the transition beam.

15. A bleacher support system according to claim 14 further comprising a starter beam attached to a forwardly end of the steep pitch support beam.

* * * * *